United States Patent [19]

Albert

[11] 3,978,467

[45] Aug. 31, 1976

[54] DOOR ALARM SYSTEM RESPONSIVE TO FORCED ENTRY

[76] Inventor: Albert F. Albert, 1029-108th N.E. No. 122, Bellevue, Wash. 98004

[22] Filed: Feb. 19, 1974

[21] Appl. No.: 443,765

[52] U.S. Cl. ..... 340/274 R; 340/276; 292/341.12; 200/61.64

[51] Int. Cl.[2] ..... G08B 13/08; H01H 27/06

[58] Field of Search ..... 340/274, 276; 292/340.12; 200/61.64, 61.67, 61.68, 61.62

[56] References Cited

UNITED STATES PATENTS

| | | | |
|---|---|---|---|
| 2,133,602 | 10/1938 | Waterbury | 292/341.12 |
| 2,660,632 | 11/1953 | Makishima | 340/274 |
| 2,866,181 | 12/1958 | Gordon | 340/274 X |
| 3,058,092 | 10/1962 | Johnson | 340/64 |
| 3,147,468 | 9/1964 | Daniels | 340/274 |
| 3,727,210 | 4/1973 | Hawkins | 340/274 |
| 3,787,832 | 1/1974 | Bolinger | 340/274 X |

*Primary Examiner*—John W. Caldwell
*Assistant Examiner*—William M. Wannisky
*Attorney, Agent, or Firm*—Cole & Jensen

[57] ABSTRACT

Alarm system in which the latch plate of the door jamb is movable to contact a striker plate spaced and insulated therefrom to close an alarm circuit. The system is so designed that if an attempt is made to force the lock, the latch plate which is resiliently mounted will move and thus make contact with the striker plate. A contact relay and thermal relay are incorporated in the alarm system in such a way that the alarm can be timed to signal for a predetermined length of time after which it will automatically shut off. As soon as the alarm signal has stopped the system is ready to signal again.

14 Claims, 5 Drawing Figures

DOOR ALARM SYSTEM RESPONSIVE TO FORCED ENTRY

BACKGROUND OF INVENTION

This invention relates generally to the field of alarm systems and more particularly to a self setting alarm system which can be adapted to doors, windows, drawers and other closure members.

Those skilled in the art are aware that existing alarm systems are subject to human error. For instance, most have to be turned on and off and if the person responsible forgets to turn the system on then it is ineffective. Most alarms which have to be turned off before entry or shortly after entry is made can be turned off by a burglar. Another common deficiency of most systems is that the alarm is triggered only after the lock or latch has been successfully broken through. In other words, the door or window has been opened. If the door has to be open before the alarm goes off, the hit-and-run type burglar still has time to pick up something before he leaves. Additionally, many existing systems are costly and furthermore many of them must be reset after they have once been triggered.

Among the prior patents are those to Schubert, U.S. Pat. No. 429,814; Cope, U.S. Pat. No. 155,626; and Ledford, U.S. Pat. No. 850,840.

SUMMARY OF THE INVENTION

The invention comprises a novel latching structure for triggering the alarm together with a unique alarm system circuit. Attached to a door frame is a contact plate which is spaced from the latch plate. The two plates are electrically insulated from each other and mounted so that the latch plate, because of its unique design and method of insulation will move if any attempt is made to force the door latch. The two plates are connected to a circuit which includes a contact relay and a thermal relay. When the two plates contact each other, no matter how instantaneously, the contact relay is energized. The contact relay is connected to the thermal relay in such a way that even though the two plates are now separated again the closed alarm circuit is maintained through the thermal relay until a predetermined time has elapsed, or if desired the relay is held closed so the alarm will signal until it is manually shut off. When the thermal relay opens after lapse of the predetermined time period the circuit is broken. The entire system remains ready to be actuated again as soon as the thermal relay has cooled and its contacts reclosed in a matter of seconds.

Accordingly, it is among the objects, features and advantages of this invention to provide an alarm system which is triggered when an attempt is made to force a lock rather than after the lock or latch is broken through. The alarm system is wired to the most vulnerable part of the door, that is the latching mechanism itself. The system does not have to be turned on or off because it is always in a state of readiness to activate as soon as the alarm means is de-energized. The system may be used to trigger a sound, a light, or both, or even connected to a telephone for silent alarm to a remote location. Additionally, the system can be connected to a radio frequency transmitting device. The system is totally invisible from the exterior as well as almost invisible from the interior. The system is economical and easy to adapt both to existing and to newly installed doors, windows or drawers. As stated above, the alarm is tripped before a burglar has actually rendered a locked door, window or drawer passable. Once it is triggered, it runs its cycle and then turns itself off and is in a readiness state almost instantly.

DESCRIPTION OF PREFERRED EMBODIMENT

Figure 1:
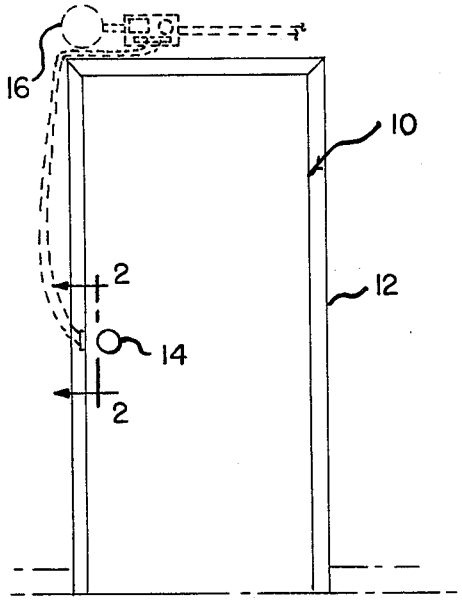
FIG. 1 is an environmental view of the alarm system showing it mounted with respect to a door.
Figure 2:
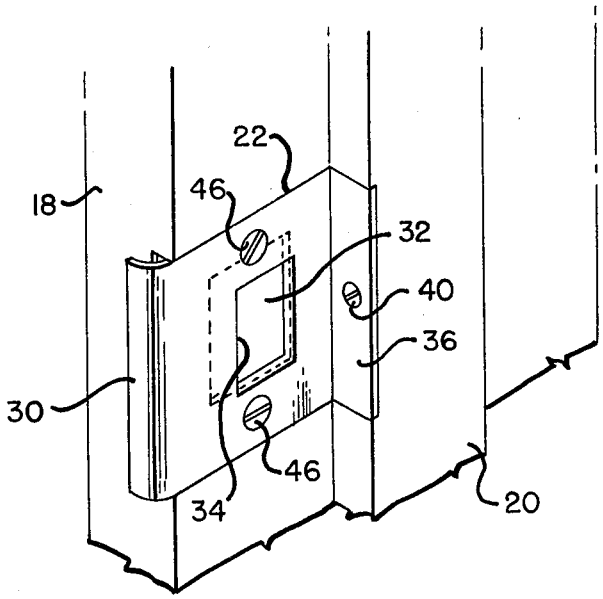
FIG. 2 is a partial view in perspective showing the contact and the latch plates in position on a door frame.
Figure 3:
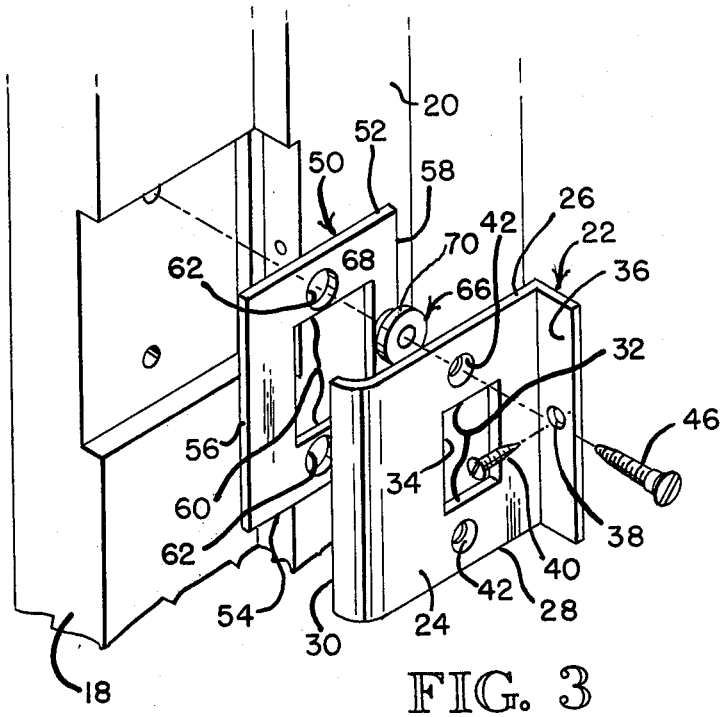
FIG. 3 is similar to FIG. 2 except that the parts have been exploded away from their installed position to further illustrate details of the invention.
Figure 4:
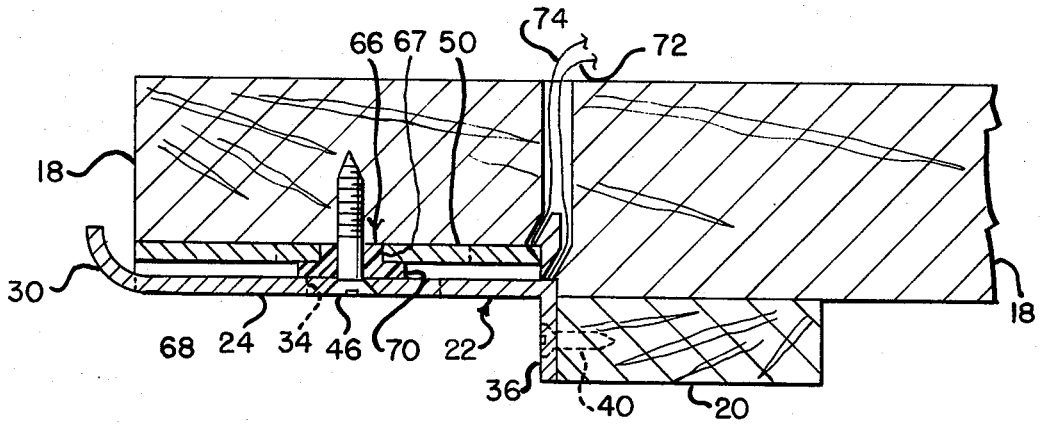
FIG. 4 is a cross sectional plan view of the latch and contact plates mounted in position and thus illustrating additional detail.
Figure 5:
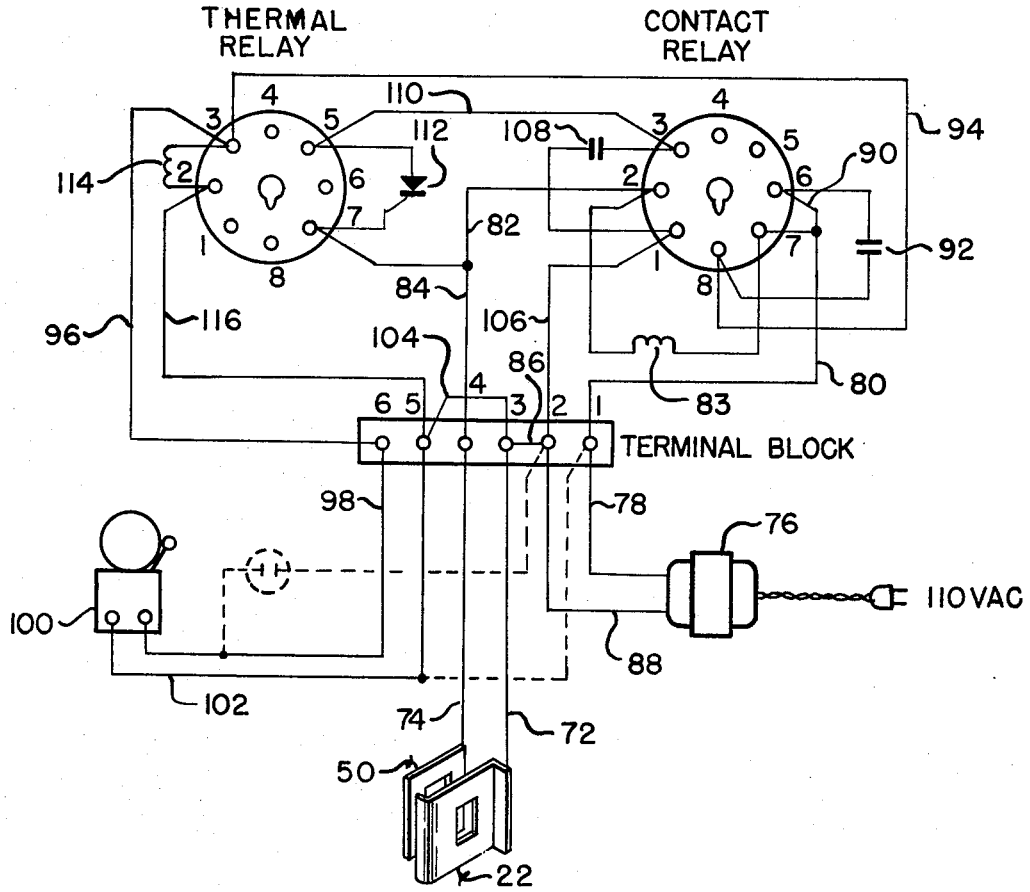
FIG. 5 is an electrical schematic diagram of the unique circuitry for the alarm system.

FIGS. 1 through 4 are illustrative of the environment in which the invention is used. A door 10 is set in a conventional frame 12 with knob 14. For purposes of illustration only the alarm system, generally designated by the number 16, is shown to be in close proximity to the door. Obviously, those skilled in the art will recognized that the alarm could be in any location within the house, building, or any other location such as would be permitted by wires or radio frequency transmitting device. Frame 12 is comprised of jamb 18 and doorstop member 20. An easily recognized but unique latch plate is generally designated by the number 22. It consists of a main section 24 having top and bottom edges 26 and 28 respectively and a curved inside edge 30 which is that portion of the latch plate which extends to that side of the door frame to which the door swings. In other words, the curved portion 30 is that portion of the latch plate which is struck when the door is being closed so as to depress the spring loaded latch. When the door is completely closed the latch will spring out and engage the edge of the latch opening. Thus there is provided latch opening 32 having latch retaining edge 34. The latch plate is provided with a short, offset door stop wall 36 which includes a mounting hole 38 for a mounting screw 40. In like manner the main portion 24 of the plate 22 has screw mounting holes 42 for receiving screws 46. The offset wall 36 prevents a person from inserting a thin blade or other commonly used tool between the latch plate and latch which is probably the most usual manner of forcing an entry.

Mounted within a recess in the door frame is a contact plate generally designated by the number 50. It is a generally rectangular member having upper and lower edges 52 and 54 respectively as well as outer edge 56 and inner edge 58. A generally rectangular opening 60 in the contact plate is somewhat larger than opening 32 in the latch plate. It also includes mounting holes 62 which are aligned with holes 42 in the latch plate to receive screws 46. It will be noted particularly in FIGS. 3 and 4 that contact plate 50 and latch plate 22 are separated by an electrically insulative and resilient grommet or gasket generally designated by the number 66. In diametrical cross section it has a T-shape such that the smaller portion 67 is received in holes 62 of the contact plate while the larger portion 70 forms a spacer between the two plates. Thus when screws 46 are in place contact plate 50 is electrically insulated both from the latch plate 22 and screws 46. An electrical lead 72 is connected to the latch plate and an electrical lead 74 is connected to the contact plate. Thus it will be seen that if a burglar uses a common method of breaking and entering he will insert a flat blade-like object between the door jamb 18 and the door stop 20. In order to force the blade all the way to the door latch which engages edge 34, he must somehow get the blade-like instrument on the frame side of the latch plate. Since the latch plate is attached to the door stop, the door stop will have to be jimmied away from the jamb. In so doing and by only slight movement of the door stop member, the latch plate will be pivoted around the resilient spacer portion 70 of the grommet and make connection with contact plate 50. The instant the latch plate strikes or touches the contact plate, no matter how briefly, a circuit is closed and the alarm triggered. Thus the latch plate is unique in that it is mounted to close a circuit if moved.

When the latch plate 22 which is connected to terminal post 3 and the contact plate 50, which is connected to terminal block post 4 make contact, current flows through a completed circuit from 24 volt transformer 76, through line 78, terminal block post 1, line 80, to pin 7 of the contact relay, through pin 2 of the contact relay via relay coil 83, line 82, line 84 through terminal block post 4, line 74, contact plate 50, latch plate 22, line 72, terminal block post 3, line 86, and thence to the transformer by line 88 to complete the circuit. Closing of this circuit causes the contact relay to change from a normally open to a closed condition. Closure of the contact relay allows current to flow through line 90, pin 6 of contact relay, contactor 92 to pin 8 of the contact relay through line 94 to pin 3 of the thermal relay. From pin 3 of the thermal relay the circuit continues through line 96, terminal block post 6, line 98, to alarm 100. The circuit continues from alarm 100, through line 102, to post 5 of the terminal block, through line 104, post 3, line 86, post 2 and line 88.

The contact relay remains in a closed condition due to the normally closed contactor 112 such as a bimetallic strip between pins 5 and 7 of the thermal relay, even though the latch plate and the contact plate may no longer be shorted or closed. Thus, a circuit is also completed from transformer 76 through line 88, terminal block post 2, line 106, to pin 1 of the contact relay, through contactor 108 to pin 3 of the thermal relay, through line 110, pin 5 of the thermal relay, normally closed contactor 112 between pins 5 and 7 of the thermal relay, line 82, contact relay coil 83, and thence by line 80 and 78 to the transformer. The contact relay will remain in the closed position until the thermal relay heater coil 114 between pins 2 and 3 of the thermal relay opens the contacts at 112 between pins 5 and 7 of the thermal relay after lapse of a perdetermined period of time. The breaking of the circuit by the thermal relay shuts off the alarm signal and allows the contact relay to assume its normally open position.

As soon as the thermal relay coil has cooled sufficiently, within a matter of seconds, the contactor elements 112 between pins 5 and 7 reclose to their normal positions thus readying the system to be triggered again as soon as the latch plate and the contact plate have been shorted.

What is claimed is:

1. An alarm system, comprising:

a. a pair of contact members mounted on a frame means adjacent a closure member to detect a forced opening of said closure member, said contact members being connected to an alarm circuit and comprising a first member generally in fixed position on said frame and a second member on said frame slightly spaced from said first member and electrically insulated therefrom, said second member being resiliently mounted for limited movement in response to movement by a portion of said frame such that upon being moved a predetermined distance it will make contact with said first member to energize said alarm circuit, b. an alarm circuit connected to said contact members including an alarm means which is actuated upon energization of said circuit by said contact members, said alarm circuit remaining energized for a predetermined time even though said contact members lose contact with each other.

2. The alarm system according to claim 1 wherein said second contact member is a latch mechanism to be engaged by said closure member.

3. The alarm system according to claim 2 and in which said latch mechanism is a door latch plate which is electrically separated from said first contact member by resilient, insulative spacer means.

4. The alarm system according to claim 3 and wherein said first contact member is a generally flat rectangular contact plate mounted in the latch recess of a door frame such that the latch plate is between the door latch and said contact plate.

5. The alarm system according to claim 4 and wherein said latch plate has an offset wall portion which is secured to the door step portion of a door frame.

6. In an alarm system including an alarm circuit and alarm mechanism for a closure member having a supporting frame, means for triggering said system, comprising:

a. a first contact member connected to said alarm circuit and secured to said frame;

b. a second contact member connected to said alarm circuit and also mounted on said frame and located outwardly of and in spaced relation to said first contact member, said second member being electrically insulated from said first member and also being resiliently mounted for limited movement, the positioning of said second with respect to the said first member being such that upon being moved a predetermined distance in response to movement of a portion of said frame it will contact said first member and thereby energized said alarm circuit and alarm mechanism.

7. The alarm system triggering means according to claim 6 and wherein said second contact member is a latch mechanism to be engaged by said closure member.

8. The alarm system triggering means according to claim 7 and in which said latch mechanism is a door latch plate which is electrically separated from said first contact member by resilient insulative spacer means.

9. The alarm system triggering means according to claim 8 and wherein said first contact member is a generally flat rectangular contact plate mounted in the latch recess of a door frame such that the latch plate is between the door latch and said contact plate.

10. The alarm system triggering means according to claim 9 and wherein said latch plate has an offset wall portion which is secured to the door stop portion of a door frame.

11. An alarm system comprising:

a. a pair of spaced apart contact members connected to an electrical circuit including a first member and a second member normally electrically insulated from one another, at least one of said contact members being movable with respect to the other so that movement thereof will cause electrical contact of said one with said other, b. an electrical circuit means energized by the contact of said contact members including an alarm signal connected to said contact members and further including a first sub-circuit and a second sub-circuit means, said first sub-circuit means energizing both said alarm signal and said second sub-circuit means when said first and second members contact each other, said second sub-circuit means holding the energized circuit closed and then opening after a predetermined time even though said first and second members are disconnected from each other.

12. The alarm system according to claim 11 and in which said first sub-circuit means includes a normally open contact relay which closes upon energization of said alarm circuit.

13. The alarm system according to claim 12 and in which said second sub-circuit means includes a normally closed thermal relay which holds said contact relay closed until the lapse of said predetermined time.

14. The alarm system according to claim 13 and in which said thermal relay automatically returns to a closed condition after the lapse of said predetermined time.

* * * * *